US006920927B2

(12) United States Patent
Hirth

(10) Patent No.: US 6,920,927 B2
(45) Date of Patent: Jul. 26, 2005

(54) METHOD AND APPARATUS FOR ANCHORING DOWNHOLE TOOLS IN A WELLBORE

(75) Inventor: David E. Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 78 days.

(21) Appl. No.: 10/429,168

(22) Filed: May 2, 2003

(65) Prior Publication Data

US 2004/0216893 A1 Nov. 4, 2004

(51) Int. Cl.[7] ..... E21B 33/129
(52) U.S. Cl. ..... 166/206; 166/208; 166/215
(58) Field of Search ..... 166/206, 208, 166/209, 210, 215, 217

(56) References Cited

U.S. PATENT DOCUMENTS

| | | | | | |
|---|---|---|---|---|---|
| 3,608,634 A | * | 9/1971 | Cochran | 166/208 |
| 4,224,987 A | * | 9/1980 | Allen | 166/120 |
| 4,441,553 A | * | 4/1984 | Setterberg et al. | 166/138 |
| 4,497,368 A | * | 2/1985 | Baugh | 166/208 |
| 4,610,300 A | * | 9/1986 | Mullins et al. | 166/134 |
| 4,640,354 A | | 2/1987 | Boisson | |
| 4,926,936 A | | 5/1990 | Braddick | |
| 5,148,866 A | * | 9/1992 | Greenlee | 166/134 |
| 5,311,938 A | | 5/1994 | Hendrickson et al. | |
| 6,378,606 B1 | * | 4/2002 | Swor et al. | 166/217 |

FOREIGN PATENT DOCUMENTS

| | | |
|---|---|---|
| GB | 2 375 560 | 11/2002 |
| RU | 2 140 518 | 10/1999 |

OTHER PUBLICATIONS

U.K. Search Report, Application No. GB0409692.1, dated Aug. 13, 2004.

* cited by examiner

*Primary Examiner*—Frank Tsay
(74) *Attorney, Agent, or Firm*—Moser, Patterson & Sheridan, L.L.P.

(57) ABSTRACT

A wellbore anchoring device for anchoring a down-hole tool within a string of casing is provided, comprising an expandable cone having at least one annular integral shoulder, defining the large end of at least one conical annular recess on an outer surface of the cone, and at least one resilient slip positioned within the at least one annular recess, wherein axial travel of the at least one slip relative to the cone is actively limited by engagement with at least one integral shoulder on the cone.

32 Claims, 7 Drawing Sheets

METHOD AND APPARATUS FOR ANCHORING DOWNHOLE TOOLS IN A WELLBORE

BACKGROUND OF THE INVENTION

Field of the Invention

The present invention generally relates to down-hole tools used in oil and gas wells, and more particularly relates to anchoring devices for use with down-hole tools.

BACKGROUND OF THE INVENTION

Anchoring devices are commonly used in oil and gas wellbores to anchor down-hole tools—such as packers or bridge plugs—to a string of casing that lines the wellbore. Many such tools require anchoring devices that are able to resist axial movement with respect to the wellbore when an axial load is applied.

The most common type of anchor device is the slip and cone assembly. The cone is comprised of a tube or bar with a cone shaped outer surface (or flats, or angles milled at an angle with respect to the cone's longitudinal axis). The slip is designed with a gripping profile on its exterior surface to engage the inner diameter of the casing, and has a conical (or tapered flat, or angled) surface on its interior that is designed to mate with the cone.

While existing slip and cone assemblies have generally proven to be reliable anchoring devices, characteristics of conventional slip and cone assemblies limit their versatility in actual down-hole environments. For example, conventional slip and cone arrangements transfer load by changing the axial force applied into a combination of axial and radial forces that are transmitted into the casing. The percentage of axial and radial forces applied is dependent upon cone angle and slip-to-cone friction; when high axial loads are applied, the radial force component can exceed the hoop strength of the casing, consequently damaging the casing. Furthermore, the cone may collapse inward below its original diameter and impede function of the down-hole tool (or restrict the passage of items or fluid through the bore). Thus, there is a need in the art for an anchor device that does not damage the casing and can resist cone collapse when subjected to radial force.

Second, the wellbores that down-hole tools are used in are commonly lined with casing that is manufactured to A.P.I. specifications. Such casing is typically specified by: (1) a nominal outer diameter dimension, and; (2) a specific weight-per-foot. The inner diameter can vary between a minimum dimension (known as "drift diameter") and a maximum dimension controlled by a maximum tolerance outer diameter and a minimum weight-per-foot. Thus the inner diameter range of a particular size and weight of casing made to A.P.I. specifications can be quite large. In addition, for each nominal size of casing, there are several weights available. Conventional slip and cone assemblies rely on the cone being smaller than the drift diameter of the heaviest weight casing it can be run in. The slip also starts out at a diameter less than the drift diameter of the heaviest weight casing. Therefore, current slip and cone assemblies are limited in maximum casing range to casing inner diameters that are less than the cone diameter plus twice the slip thickness. Otherwise, the slip would pass axially over the cone, and the anchor would be unable to transfer any load. Thus, for reasons of simplicity and inventory reduction, there is a need in the art for an anchoring device that covers as wide a range of casing inner diameters as possible.

Third, as the slip rides up the cone, the contact area between the slip and cone becomes smaller and smaller, until the outer surface of the slip engages the inner diameter of the casing. As the contact area between the slip and cone becomes smaller, the ability of the cone to support the slip is diminished, and consequently so is the casing area that the radial forces have to act on (which increases the stress in the casing). As the casing inner diameter increases due to strain from the applied load, a continued reduction in the supported cone/slip contact occurs, and the anchoring capacity decreases, until, finally, the casing fails, the slip overrides the cone, or the cone collapses. Thus, there is a need in the art for an anchoring device whose performance is not compromised when the inner diameter of the casing is increased by slip-induced radial forces, or when it is used in lighter weights of casing with larger inner diameters.

Fourth, conventional slips start out with an outer gripping surface manufactured to a certain diameter. As the slip is moved up the cone, it contacts the inner diameter of the casing. The inner diameter of the casing will fall within a range of diameters—only one of which will match the outer diameter of the slip. A mismatch in curvature will cause the slip to contact the casing at points, rather than contact it uniformly over the slip/casing surface. With slips and cones that have mating conical surfaces, a similar curvature mismatch will occur between the inner diameter of the slip and the cone as the slip rides up. This type of mismatch usually leads to deformation of the slip at higher loads, and the stress concentrations induced by the point loading can damage the casing, as well as the slip and/or cone. Thus, there is a need in the art for a slip with a variable outer diameter that is capable of limiting or eliminating curvature mismatch with a range of casing inner diameters, as well as with the cone.

Fifth, the cone angle of a slip and cone anchor is always a compromise between having an angle that is shallow enough to allow the anchor to grip the casing, yet steep enough to limit the radial forces transmitted to the casing and cone. Thus, there is a need in the art for an anchor device that exerts sufficient radial force to ensure engagement with the casing, yet limits that radial force below a magnitude that would damage the casing or cone.

Sixth, one of the most common methods for increasing the load capacity of a slip and cone assembly is to increase the area that the radial forces are distributed across. This can be done by either increasing the lengths of the slip and the cone, or by increasing the numbers of slips and cones used. However, increasing the slip length or number adds to the cost and length of the down-hole tool. Thus, there is a need in the art for a high-load anchor device that has fewer slips and is shorter in length than current devices.

Seventh, when down-hole tools are run in wellbores that are deviated or horizontal, the tool string lays to the low side of the wellbore. When a conventional slip and cone assembly is deployed, part of the force to set the anchor is consumed trying to lift the tool string so that it is centered in the wellbore. If the setting force of the anchor is limited, there may not be sufficient force to center the tool string, and the low side of the slip will contact the low side of the casing, which often collects debris. With the only slip contact area of the casing covered with debris, the ability of the slip to initiate a grip is reduced, increasing the likelihood that it will slide in the casing. Thus, there is a need in the art for an anchor device whose performance is unaffected by the presence of debris on the low side of a non-vertical wellbore.

Eighth, in wellbore anchoring applications such as liner hangers, bypass area around the slips is necessary to circulate fluids and cement through the casing. Current liner hangers create bypass areas by using several slips and cones with gaps between them. However, current slip and cone designs close off the area above the cone as the slip travels up to grip the casing, reducing bypass area. Using few slips with large gaps between them causes the casing and cone to be radially point loaded in a way that induces a non-round section, increasing stresses and impeding the passage of tools through the effective reduced inner diameter. Adding more slips maintains the circular shape of the casing, but adds to cost and complexity. Thus, there is a need in the art for an anchor device that radially loads the casing and cone in a more uniform manner and maintains a large bypass area even after the slips have initiated a grip with the casing.

Ninth, in expandable liner applications, current practice is to stay tied onto the liner during cementing and expansion, and then set a liner hanger during or after the expansion process. This method increases the risks associated with not being able to activate the liner hanger and/or release the running tool when cement is displaced around the liner top. Conventional slip and cone assemblies are not conducive to expansion of the liner hanger after the anchors have been set because of the close proximity of the mandrel, cone, and slip. Thus, there is a need in the art for a liner hanger than can be run with expandable liners and set prior to the liner or liner hanger expansion.

Therefore, a need exists in the art for an improved slip and cone assembly. The above concerns are addressed by the assembly of the present invention.

SUMMARY OF THE INVENTION

In one embodiment, the invention is a wellbore anchoring device for anchoring a down-hole tool within a string of casing, comprising an expandable cone having at least one annular integral shoulder, defining the large end of at least one conical annular recess on an outer surface of the cone, and at least one resilient slip positioned within the at least one annular recess, wherein axial travel of the at least one slip relative to the cone is actively limited by engagement with at least one integral shoulder on the cone.

Another embodiment of the present invention is a down-hole tool for use in a wellbore, wherein the tool comprises a mandrel, an expanding cone positioned over the mandrel, wherein the cone has a plurality of integral shoulders that defines at least one annular recess on an outer surface of the cone, and at least one slip positioned within the at least one annular recess, wherein axial travel of the at least one slip relative to the cone is actively limited by the plurality of integral shoulders on the cone.

In a further embodiment, the invention is a method for diametrically expanding a down-hole cone within a casing, comprising the steps of positioning a cone having a wedge-shaped gap within the casing, applying axial force to a wedge-shaped member that is slidably engaged within the wedge-shaped gap and positioned parallel to a longitudinal axis of the cone, urging the wedge-shaped member axially through the wedge-shaped gap.

BRIEF DESCRIPTION OF THE DRAWINGS

So that the manner in which the above recited embodiments of the invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION OF THE PREFERRED EMBODIMENT

Figure 1C:
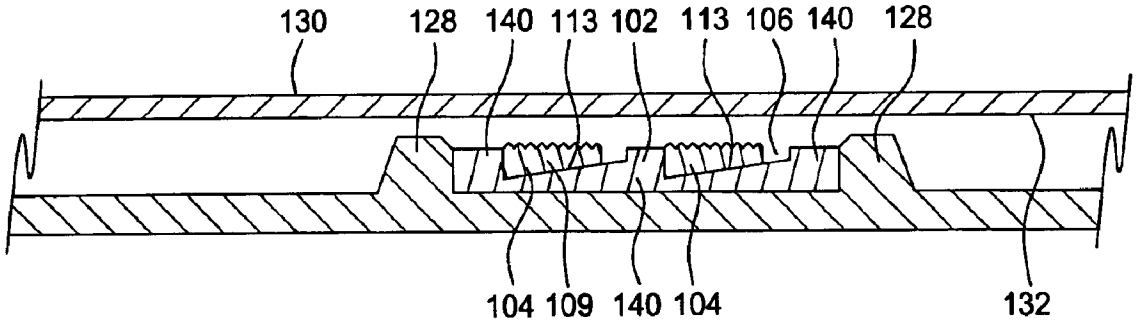
FIG. 1C is a longitudinal sectional view illustrating the anchoring device of FIG. 1A relative to a string of casing.
Figure 1A:
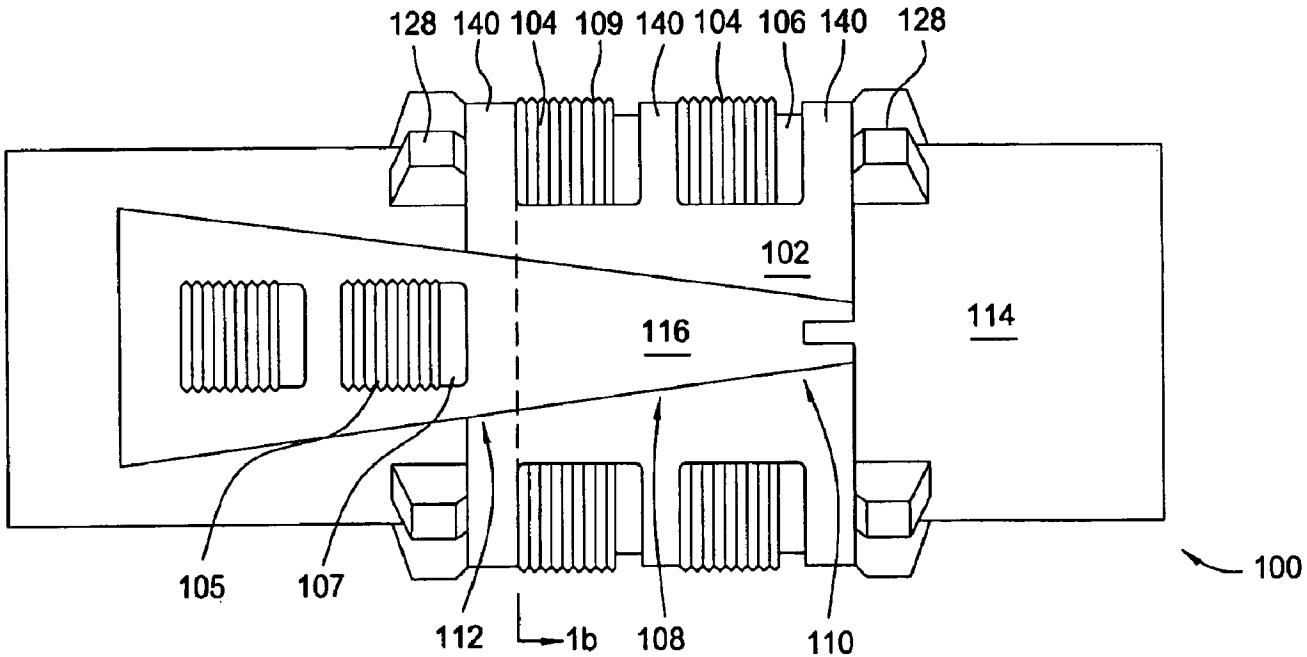
FIG. 1A is a perspective view of an anchoring device according to one embodiment of the present invention.

FIG. 1A is a perspective view of a slip and cone assembly 100 according to one embodiment of the present invention. The assembly 100 comprises a resilient, expandable cone 102 and at least one resilient, expandable slip 104.

Figure 1B:
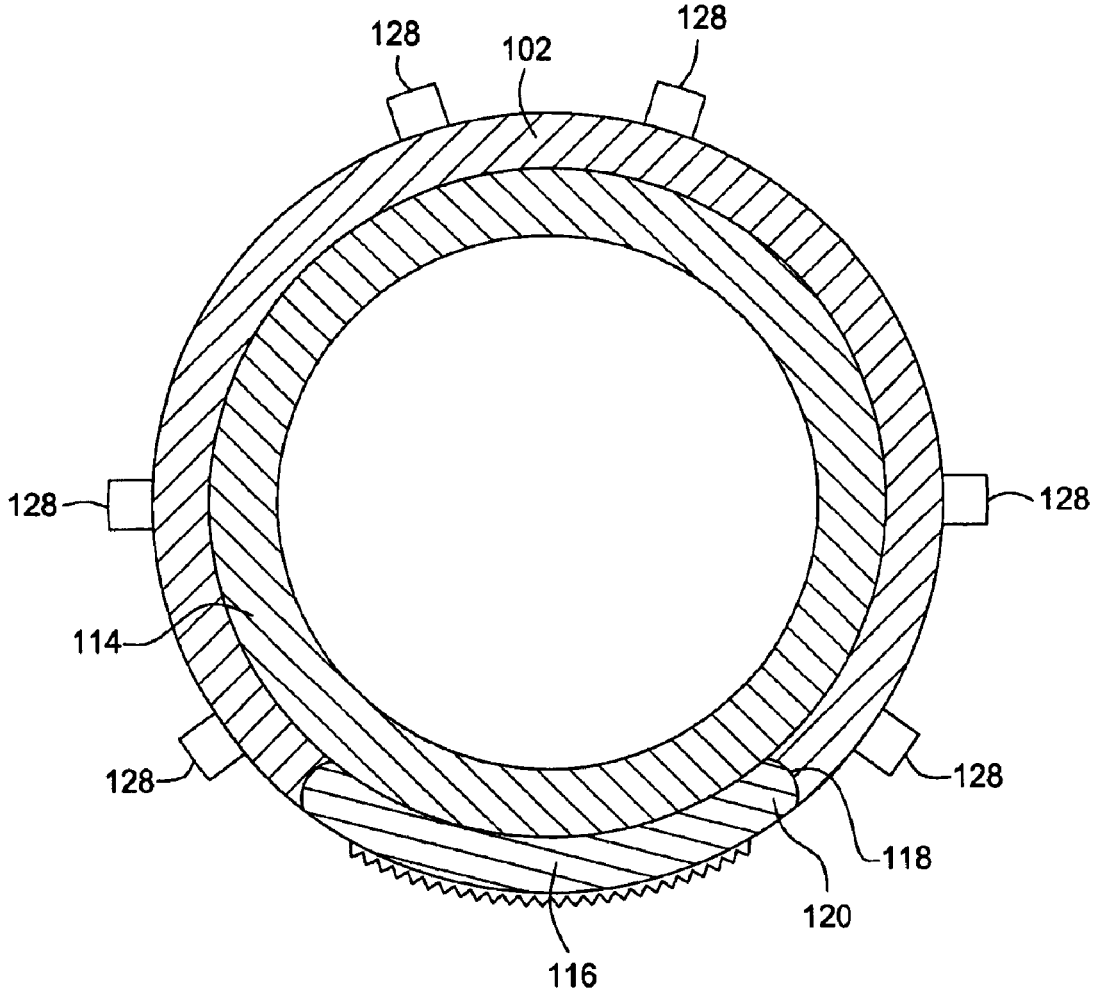
FIG. 1B is a cross sectional view of the anchoring device illustrated in FIG. 1A, taken along line 1B—1B of FIG. 1A.

The cone 102 is typically positioned over a mandrel 114 that, prior to the setting of the slip(s), is supported by a string of tubing, or a portion of a down-hole tool (for example, a liner hanger). Shoulders 128 on the mandrel 114 retain the cone 102 in place and are spaced at least far enough apart longitudinally to allow for the length of the cone. In one embodiment, the cone 102 comprises a C-shaped ring having a plurality of integral shoulders 140 on an outer surface of the cone 102 that defines at least one annular recess 106 with a conical surface 113 extending around the circumference of the cone 102. A wedge-shaped gap 108 in the cone 102 widens progressively from a first upper end 110 to a second lower end 112. A wedge-shaped member 116 is slidably engaged with the wedge-shaped gap 108 and is positioned substantially parallel to the cone's longitudinal axis. Preferably, the wedge-shaped member 116 has an arcuate cross-section to conform to the surface of the mandrel 114. As illustrated in FIG. 1B, the edges of the gap 108 comprise rounded grooves 118 into which the rounded edges 120 of the wedge-shaped member 116 fit. The length of the wedge-shaped member 116 is greater than that of the wedge-shaped gap 108, and integral shoulders may be formed on the wedge-shaped member as well to define at least one recess 107.

At least one slip 104 comprises a C-shaped annular gripping surface, comprising a plurality of radially extending gripping teeth 109, that extends around the outer circumference of the slip 104 and is positioned within the at least one annular recess 106 on the cone 102. Alternatively, the at least one slip 104 may comprise a plurality of arcuate segments. In the embodiment illustrated in FIG. 1A, two slips 104 are supported within two recesses 106 on the cone surface. The shoulders 140 that define the recesses 106 limit axial movement of the slips 104 relative to the cone 102. In addition, at least one slip 105 may positioned within the recess 107 on the wedge-shaped member 116. In the embodiment depicted in FIG. 1A, two such slips 105 are utilized.

FIG. 1C illustrates a longitudinal sectional view of the slip and cone assembly 100 of FIG. 1A with respect to a string of casing 130. Before force is applied to the cone 102, the assembly 100 preferably does not contact the inner diameter 132 of the casing 130, thus the slips 104 (and 105 in FIG. 1A) do not yet engage the casing 130. Shoulders 128 define a diameter that is larger than the diameter of the slips 104, and they prevent the slips 104 from engaging the casing until the cone 102 and slips 104 are expanded.

Figure 1E:
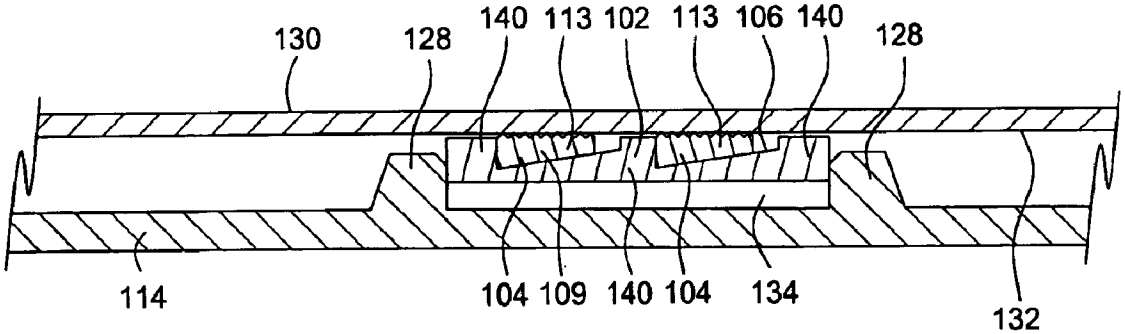
FIG. 1E is a longitudinal sectional view illustrating the anchoring device of FIG. 1A engaged with a string of casing.
Figure 1D:
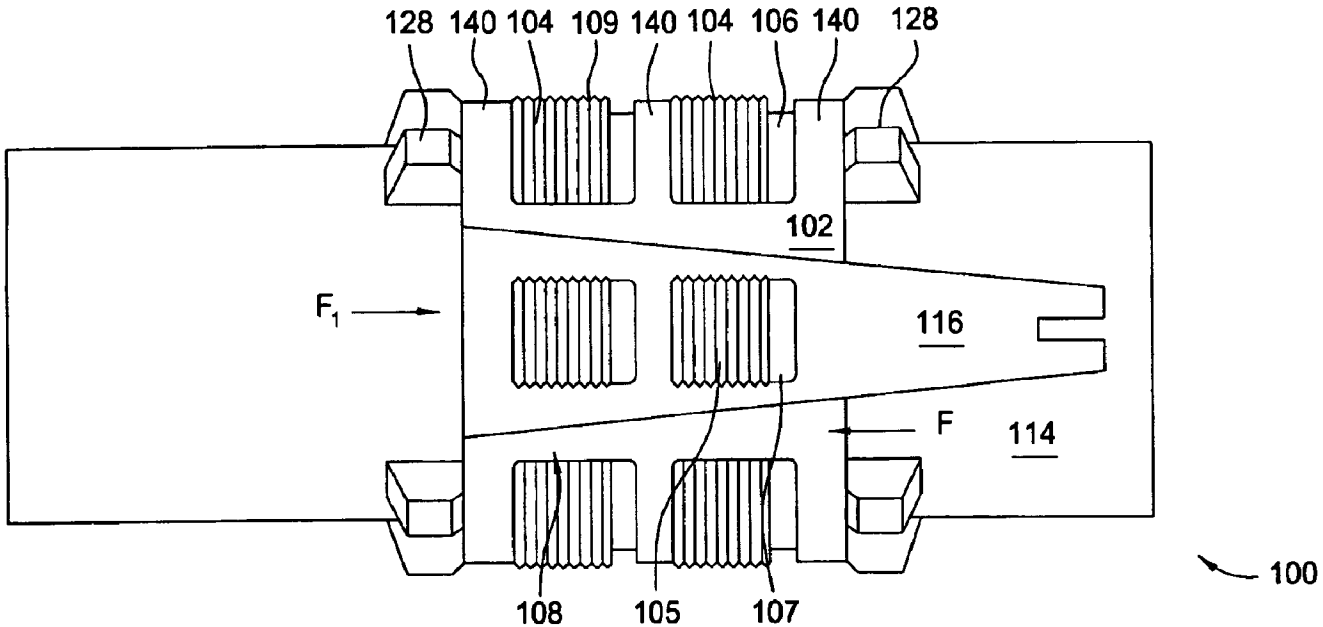
FIG. 1D is a perspective view of the anchoring device illustrated in FIG. 1A in an "engaged" position.

With the cone 102 held stationary with respect to the string of casing 130 by a downward axial force F (FIG. 1D), an upward axial force F' is applied to the wedge-shaped member 116, forcing the wedge 116 upward and causing the cone 102 to expand outward. As illustrated by FIG. 1D, as the wedge-shaped member 116 slides upward through the gap 108 in the cone 102, the gap 108 widens, causing the cone 102 to expand radially. Thus the slips 104 expand radially as well, while remaining fully engaged with the cone's conical surface. The cone 102 and slips 104 expand until the slips 104, 105 contact the inner wall 132 of the casing 130, as illustrated in FIG. 1E. The resilience and expandability of the cone 102 and slips 104 is such that at this point, substantially the entire inner surface of the slips 104 engages the cone 102, and substantially the entire gripping surface engages the inner wall 132 of the casing 130.

Figure 1F:
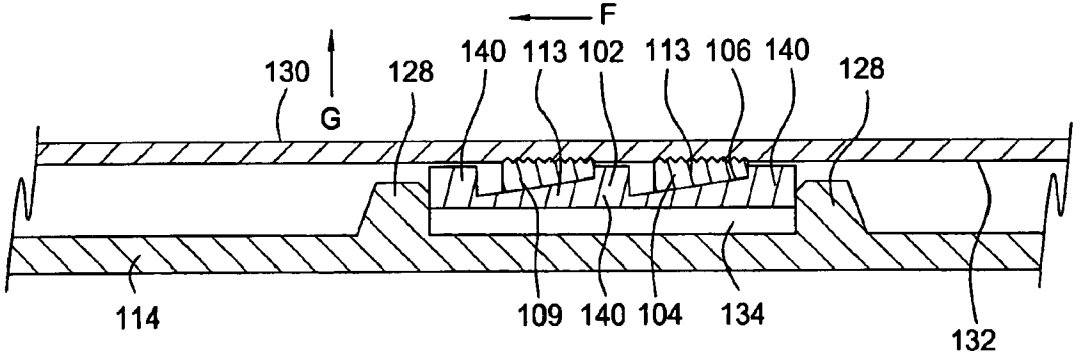
FIG. 1F is a perspective view of the anchoring device illustrated in FIG. 1D under axial loading.
Figure 1G:
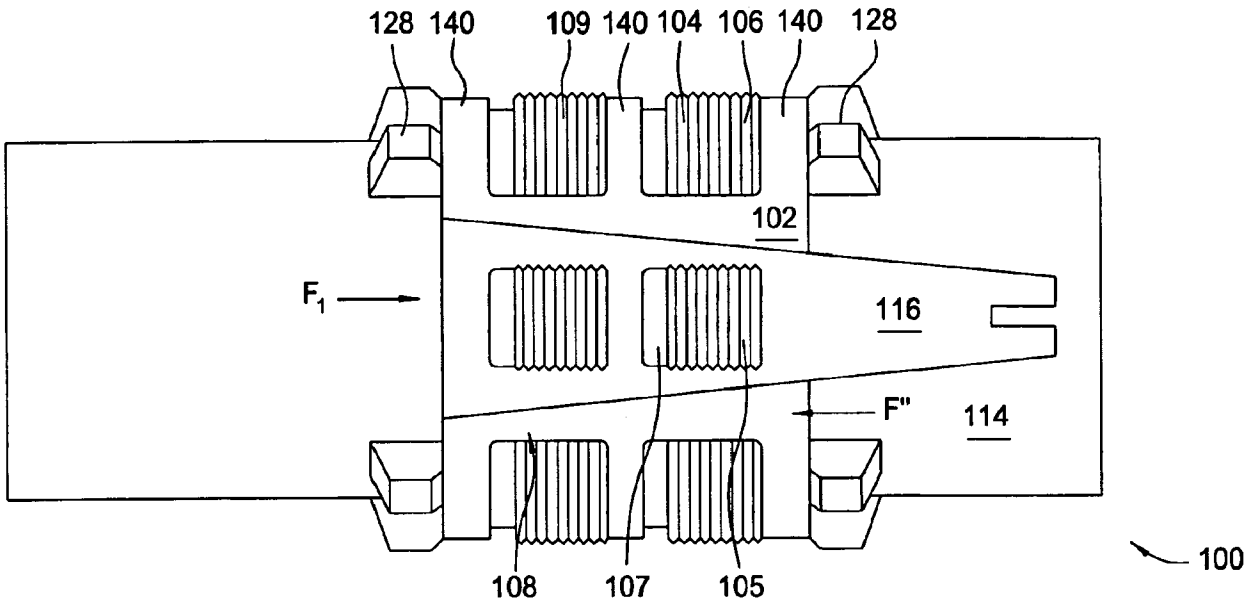
FIG. 1G is a longitudinal sectional view illustrating the anchoring device of FIG. 1F under axial loading and relative to a string of casing.

At this point, as illustrated in FIGS. 1F–G, axial load F" applied to the cone 102 is transferred into radial force R, and the radial load causes the slips 104, 105 to partially penetrate and expand the casing 130 as the cone 102 is loaded downward. The downward load also causes the cone 102 to be moved downward while the slips 104 are held stationary by the engagement of the slip gripping surfaces with the casing wall 132. In this way, the conical bottoms of the recesses 106, 107 move downward, forcing the slips 104 further radially outward so that they penetrate and engage the casing 130. In this way, the anchor is set. Note that the shoulders 140 on the cone 102 actively limit axial travel of the cone 102 under the slips 104 to a predetermined point where it will not damage the casing 130. Furthermore, the shoulders 140 directly transfer any additional axial load in the slip/cone assembly 100 into the casing 130 as axial force. Thus, the amount of relative axial travel between the slips 104 and cone 102 can be limited to that amount required to penetrate the casing 130 as needed.

Figure 2B:
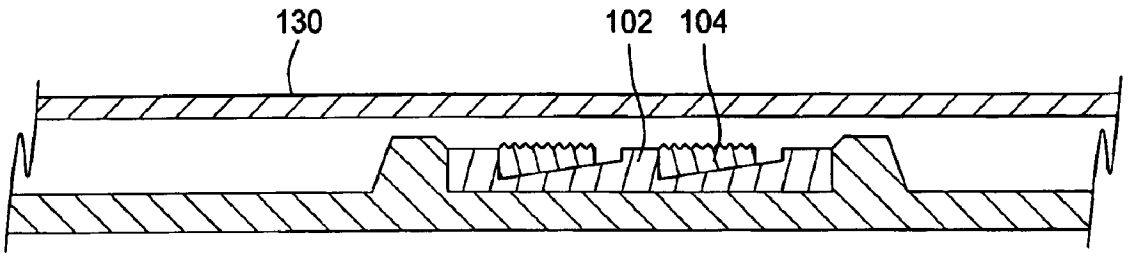
FIG. 2B is a longitudinal sectional view illustrating the anchoring device of FIG. 2A relative to a string of casing.
Figure 2A:
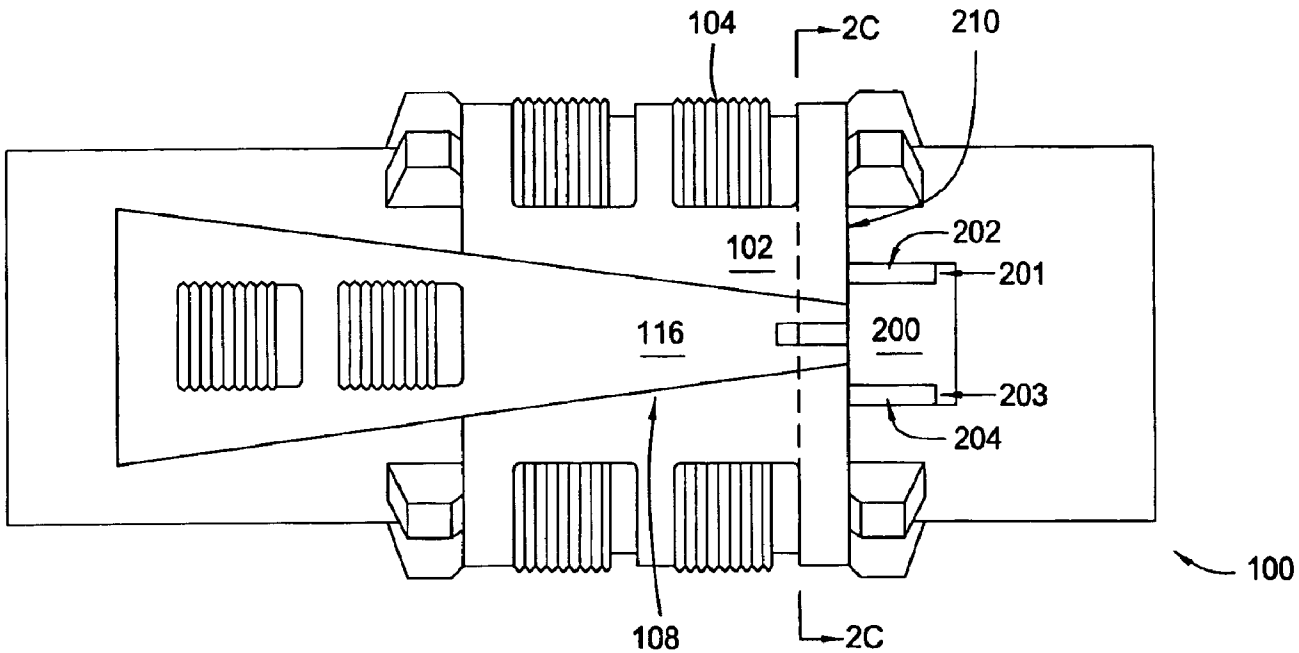
FIG. 2A is a perspective view of a second embodiment of an anchoring device according to the present invention.
Figure 2C:
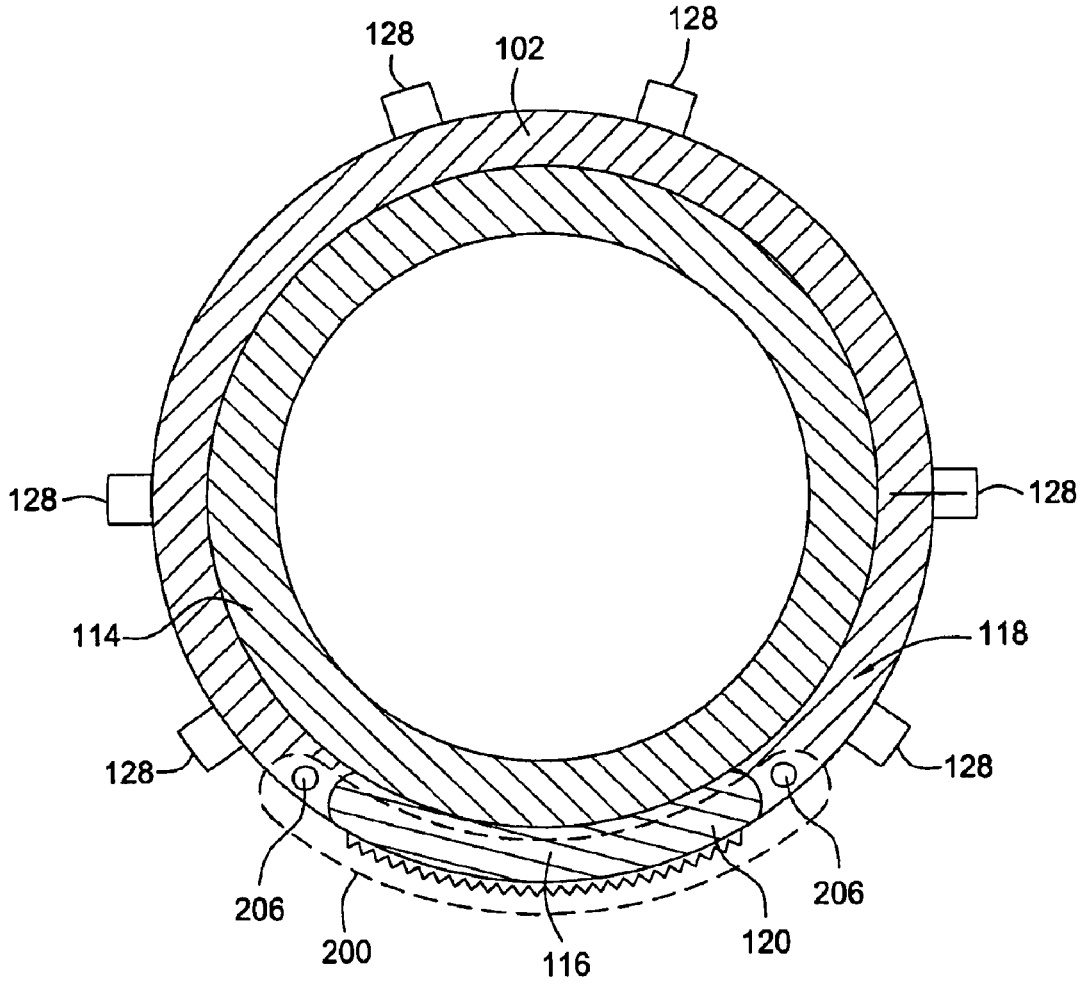
FIG. 2C is a cross sectional view of the anchoring device illustrated in FIG. 2A, taken along line 2C—2C of FIG. 2A

In the alternative, the slip and cone assembly 100 may be machined in an expanded state, and held compressed while run into the wellbore. For example, in one embodiment illustrated in FIGS. 2A–C (showing the assembly 100 in a position to be run into a string of casing 130), the wedge-shaped member 116 further comprises a block-shaped component 200 mounted to its narrow end. A first pin 202 extends from a first end 201 of the block 200, and a second pin 204, oriented substantially parallel to the first pin 202, extends from a second end 203 of the block 200. The set of pins 202, 204 extends toward the cone 102 and engages mating holes 206 formed into the top 210 of the cone 102, on either side of the wedge-shaped gap 108. As illustrated in FIG. 2C, the mating holes 206 are formed substantially parallel to a central axis C of the mandrel 114. The pins 202, 204 thus hold the cone 102 in a compressed state, and the assembly 100 may be run into the wellbore as such. The pins 202, 204 are of a short enough length that sufficient relative axial movement between the wedge-shaped member 116 and the cone 102 will release the pins 202, 204 from the mating holes 206, allowing the cone 102 to expand radially to its full machined diameter so that the slips 102 can engage the casing 130. Thus, the wedge-shaped member 116 may be further driven into the gap 108 more for support, rather than relying entirely on the wedge-shaped member 116 for expansion purposes.

Figure 3B:
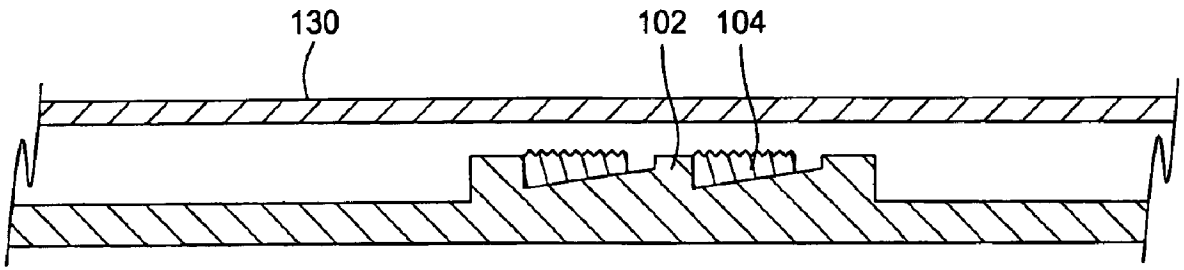
FIG. 3B is a longitudinal sectional view of the anchoring device of FIG. 3A.
Figure 3A:
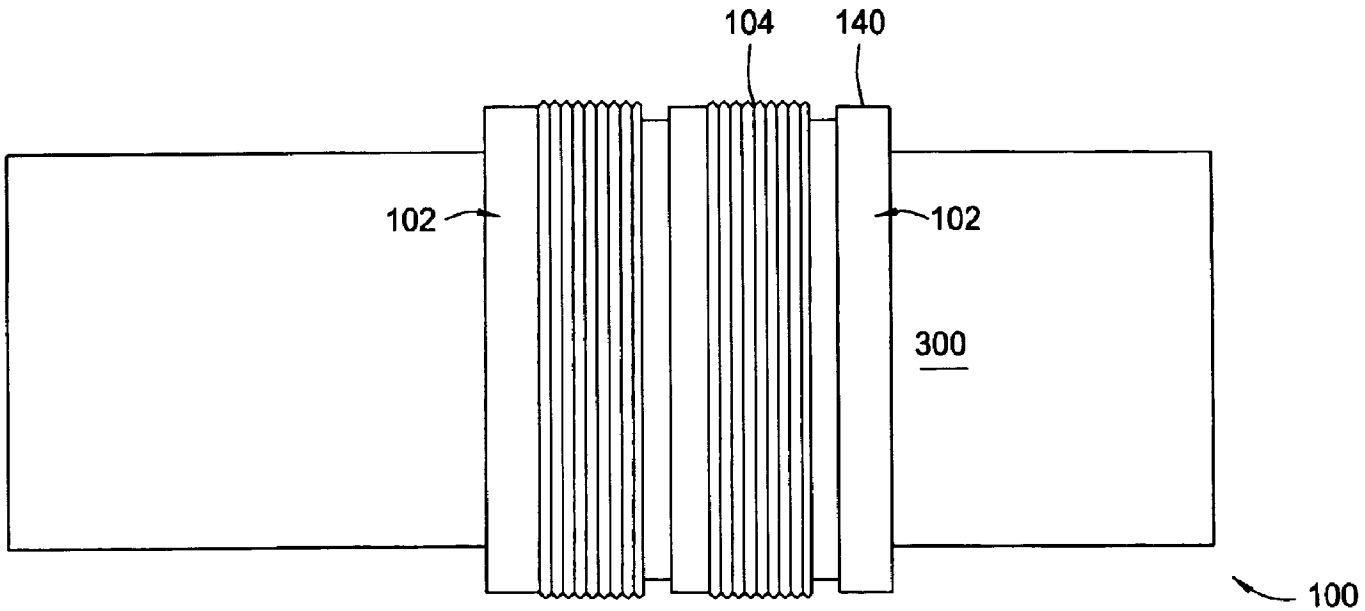
FIG. 3A is a perspective view of a third embodiment of an anchoring device according to the present invention.

In a further embodiment, the cone 102 may be formed integrally with an expandable tool body 300 (for example, a liner hanger), as illustrated in FIG. 3. Those skilled in the art will appreciate that such a cone 102 may be expanded by any one of several known expansion techniques (including, but not limited to, the use of cones or compliant rollers), rather than be expanded by a slidably engaged wedge. A cone 102 such as that described herein, comprising integral shoulders 140 to limit slip travel, would be an improvement over existing expandable liner hangers. Fluids would be pumped into the wellbore prior to expansion and setting of the tool 300, so that fluid bypass would not be impeded by the integral hanger/cone configuration. However, it will be appreciated that provisions for bypass could be made around such a hanger in the form of grooves or channels through the slip 104 and cone 102 members.

Thus, the present invention represents a significant advancement in the field of wellbore anchoring devices. The slip and cone assembly 100 limits radial forces acting on the cone 102; reactive radial inward forces that would normally collapse the cone 102 are distributed around the full circle of the C-shaped cone 102, with the wedge-shaped member 116 transferring load across the gap 108. Axial force is applied to the wedge-shaped member 116 only during the setting process, so it does not generate any additional radial forces once the cone 102 is expanded. Therefore, by limiting the radial forces generated by the assembly 100, potential collapse of the cone, as well as overstress of the casing 130, can be reduced or eliminated. Additionally, because radial forces are essentially locked out, a very shallow slip-to-cone angle can be used to improve the process of initiating penetration of the casing 130. And since the travel-limiting shoulders 140 will limit further relative axial movement of the slips 104 and cone 102, no additional radial component should be transferred once the cone/slip travel limit is reached.

In addition, with limited radial forces to distribute, no additional area is required to distribute the load. Therefore, much shorter (and therefore less complex and costly) slips 104 may be used that will still carry the same load as conventional long and multi-row slips. Also, a smaller slip footprint can be created to give a higher initial slip-to-casing contact, which will improve the initiation of the grip.

Furthermore, the assembly uses the travel of the cone expansion to bridge the gap between the outer diameter of the slips 104 and the inner diameter 132 of the casing 130. By making the cone 102 expandable, slip expansion is not limited by slip thickness, and the slips can extend much further than in conventional designs. Therefore, the assembly 100 is more versatile, and may be used in conjunction with a broad range of casings having various inner diameters. Moreover, because the relatively thin slips 104 expand with the cone 102 to match the inner diameter curvature of the casing 130, the point contact created by conventional slips is avoided, reducing the likelihood of damage to the slips, cone or casing at higher loads. And because the slips 104 expand to fully contact the casing inner wall 132, debris on the low side of a non-vertical wellbore becomes less of a concern, since the slips 104 grip the side and upper sections of the casing 130 as well as the bottom.

Additionally, because the cone 102 expands until the slips 104 contacts the inner wall 132 of the casing 130 and before any relative travel between the slips 104 and cone 102 occurs, no slip-to-cone interface is initially sacrificed by expanding the slips 104 out to different casing inner diameters, and there is constant slip-to-cone interface across the pertinent portion of casing 130, even at higher loads. Thus the likelihood that the slips 104 will override the cone 102, or that the cone 102 will collapse under increased load, is substantially reduced.

Furthermore, the loss of bypass area around the anchoring device is reduced. The bypass area of the assembly is over (or outside) the cone 102 before setting, and under (or inside) the cone 102 after setting. As the cone 102 is expanded outward, the bypass area underneath it is expanded as well. Even when the slip expands to its maximum, there is no loss of bypass area because the expansion of the slip corresponds to the limited casing expansion from the controlled radial load. The only bypass area reduction is during setting and is due to the increased width that the wedge-shaped member 116 occupies when the cone 102 is expanded, and this reduction is relatively minimal.

Lastly, as the assembly 100 sets, the cone is expanded away from the body of the tool or mandrel. This permits the mandrel to be expanded as well to an outer diameter that fits within the expanded inner diameter of the cone 102 in the set position. This permits a liner hanger to be set and released prior to the liner and/or liner hanger body being expanded. The potential for a significant decrease in the thicknesses of the cone 102 and slips 104 relative to conventional designs makes the assembly 100 particularly useful for expandable applications.

While the foregoing is directed to embodiments of the invention, other and further embodiments of the invention may be devised without departing from the basic scope thereof, and the scope thereof is determined by the claims that follow.

What is claimed is:

1. A wellbore anchoring device for anchoring a down-hole tool within a string of casing, comprising:

an outwardly expandable cone having at least one integral shoulder, wherein the cone is radially expandable from a first diameter to a second larger diameter;

at least one substantially conical recess on a surface of the cone; and at least one resilient slip positioned within the at least one recess, wherein axial travel of the at least one slip relative to the cone is actively limited by engagement with at least one integral shoulder on the cone.

2. The wellbore anchoring device of claim 1, wherein the expandable cone is engageable with substantially the entire inner surface of the at least one slip.

3. The wellbore anchoring device of claim 1, wherein the expandable cone further comprises:

a C-shaped ring having a longitudinal wedge-shaped gap that widens progressively from a first end to a second end; and a wedge-shaped member slidably engaged with the wedge-shaped gap, wherein the edges of the wedge-shaped gap and of the wedge-shaped member have inter-engaging configurations.

4. The wellbore anchoring device of claim 3, wherein the wedge-shaped member further comprises:

at least one integral shoulder;

at least one substantially conical recess on a surface of the wedge-shaped member; and at least one slip positioned within the at least one recess, wherein axial travel of the at least one slip relative to the cone is actively limited by engagement with at least one integral shoulder on the wedge-shaped member.

5. The wellbore anchoring device of claim 1, wherein the at least one slip comprises an arcuate gripping surface capable of penetrating an inner wall of the casing.

6. The wellbore anchoring device of claim 5, wherein the resilience of the slip is sufficient to allow substantially the entire gripping surface to penetrate the inner wall of the casing.

7. The wellbore anchoring device of claim 4, wherein the wedge-shaped member is slidable axially relative to the rest of the cone to widen the wedge-shaped gap and expand the cone and the at least one slip.

8. The wellbore anchoring device of claim 7, wherein a fluid bypass area is defined under the cone by expansion of the cone and the at least one slip.

9. The wellbore anchoring device of claim 3, wherein the cone is adapted to be retained in a non-expanded state when run into a string of casing.

10. The wellbore anchoring device of claim 9, wherein the wedge-shaped member further comprises a flange coupled to the narrow end of the wedge-shaped member by:

a first pin extending from a first end of the flange; and a second pin extending from a second end of the flange.

11. The wellbore anchoring device of claim 10, further comprising:

a first hole drilled into the cone on a first side of the wedge-shaped gap; and a second hole drilled into the cone on a second side of the wedge shaped gap, opposite the first side, wherein the first and second holes engage the first and second pins extending from the wedge-shaped member to prevent the cone from expanding.

12. A down-hole tool for use in a wellbore, wherein the tool comprises:

a tool body;

an outwardly expandable cone coupled to the tool body and having at least one integral shoulder, wherein the cone is capable of radially expanding from a first diameter to a second larger diameter;

at least one substantially conical recess on a surface of the cone; and at least one resilient slip positioned within the at least one recess, wherein axial travel of the at least one slip relative to the cone is actively limited by engagement with at least one integral shoulder on the cone.

13. The down-hole tool of claim 12, wherein the expandable cone is engageable with substantially the entire inner surface of the at least one slip.

14. The down-hole tool of claim 13, wherein the expandable cone further comprises:

a C-shaped ring having a longitudinal wedge-shaped gap that widens progressively from a first end to a second end; and a wedge-shaped member slidably engaged with the wedge-shaped gap, wherein the edges of the wedge-shaped gap and of the wedge-shaped member have inter-engaging configurations.

15. The down-hole tool of claim 14, wherein the wedge-shaped member further comprises:

at least one integral shoulder;

at least one substantially conical recess on a surface of the wedge-shaped member; and at least one slip positioned within the at least one recess, wherein axial travel of the at least one slip relative to the cone is actively limited by engagement with at least one integral shoulder on the wedge-shaped member.

16. The down-hole tool of claim 14, wherein the slip comprises a C-shaped annular gripping surface capable of penetrating an inner wall of a string of casing in the wellbore.

17. The down-hole tool of claim 14, wherein the wedge-shaped member is slidable axially relative to the rest of the cone to widen the wedge-shaped gap and expand the cone and the at least one slip.

18. The down-hole tool of claim 17, wherein a fluid bypass area is defined under the cone by expansion of the cone and the at least one slip.

19. The down-hole tool of claim 12, wherein the tool is an expandable liner hanger.

20. The down-hole tool of claim 19, wherein a mandrel of the liner hanger is expandable after expansion of the cone and the at least one slip.

21. The down-hole tool of claim 19, wherein the cone is formed integrally with the expandable liner hanger body.

22. A wellbore anchoring device for anchoring a down-hole tool within a string of casing comprising:

an expandable cone having at least one integral shoulder;

at least one substantially conical recess on a surface of the cone;

at least one resilient slip positioned within the at least one recess, wherein axial travel of the at least one slip relative to the cone is actively limited by engagement with at least one integral shoulder on the cone;

a longitudinal wedge-shaped gap in the cone that widens progressively from a first end to a second end;

a wedge-shaped member slidably engaged with the wedge-shaped gap, wherein the edges of the wedge-shaped gap and of the wedge-shaped member have inter-engaging configurations;

at least one integral shoulder on the wedge-shaped member;

at least one substantially conical recess on a surface of the wedge-shaped member; and at least one slip positioned within the at least one conical recess, wherein axial travel of the at least one slip relative to the cone is actively limited by engagement with at least one integral shoulder on the wedge-shaped member.

23. The wellbore anchoring device of claim 22, wherein the at least one slip comprises an arcuate gripping surface capable of penetrating an inner wall of the casing.

24. The wellbore anchoring device of claim 22, wherein the cone is adapted to be retained in a non-expanded state when run into a string of casing.

25. The wellbore anchoring device of claim 24, wherein the wedge-shaped member further comprises:

a flange coupled to a narrow end of the wedge-shaped member;

a first pin extending from a first end of the flange; and a second pin extending from a second end of the flange.

26. The wellbore anchoring device of claim 25, further comprising:

a first hole drilled into the cone on a first side of the wedge-shaped gap; and a second hole drilled into the cone on a second side of the wedge shaped gap, opposite the first side, wherein the first and second holes engage the first and second pins extending from the wedge-shaped member to prevent the cone from expanding.

27. A method for diametrically expanding a down-hole cone within a casing, comprising the steps of:

positioning a cone having a wedge-shaped gap within the casing;

applying axial force to a wedge-shaped member that is slidably engaged within the wedge-shaped gap and positioned parallel to a longitudinal axis of the cone; and urging the wedge-shaped member axially through the wedge-shaped gap.

28. The method of claim 27, wherein the step of urging the wedge-shaped member through the wedge shaped gap further comprises the step of engaging outer edges of the wedge-shaped member with grooves defined longitudinally along edges of the wedge-shaped gap.

29. The method of claim 27, wherein the movement of the cone moves slips into engagement with an inner wall of the casing.

30. A method for diametrically expanding a down-hole cone within a casing, comprising the steps of:

machining an expanded cone having a wedge-shaped gap;

positioning a wedge-shaped member within the wedge-shaped gap and oriented parallel to a longitudinal axis of the cone;

compressing the cone;

fixably connecting the wedge-shaped member to the cone to hold the cone in the compressed state;

running the cone into the casing; and applying axial force to the wedge-shaped member to break the connection to the cone.

31. The method of claim 30, further comprising the step of urging the wedge-shaped member through the wedge-shaped gap.

32. A method for diametrically expanding a down-hole cone within a casing, comprising the steps of:

forming a cone, having integral shoulders for limiting travel of at least one slip supported on an outer circumference of the cone, integrally with an expandable liner hanger;

running the expandable liner hanger into a string of casing; and diametrically expanding the liner hanger.

* * * * *